US006842158B2

(12) United States Patent
Jo et al.

(10) Patent No.: US 6,842,158 B2
(45) Date of Patent: Jan. 11, 2005

(54) WIDEBAND LOW PROFILE SPIRAL-SHAPED TRANSMISSION LINE ANTENNA

(75) Inventors: Young-Min Jo, Rockledge, FL (US); Young-Ki Kim, Palm Bay, FL (US); Kyu-Young Han, Palm Bay, FL (US); Sean F. Sullivan, Palm Bay, FL (US); Jay A. Kralovec, Melbourne, FL (US)

(73) Assignee: SkyCross, Inc., Melbourne, FL (US)

( * ) Notice: Subject to any disclaimer, the term of this patent is extended or adjusted under 35 U.S.C. 154(b) by 6 days.

(21) Appl. No.: 10/331,105

(22) Filed: Dec. 27, 2002

(65) Prior Publication Data

US 2003/0156065 A1 Aug. 21, 2003

Related U.S. Application Data

(60) Provisional application No. 60/344,255, filed on Dec. 27, 2001.

(51) Int. Cl.[7] ..... H01Q 1/36
(52) U.S. Cl. ..... 343/895; 343/700 MS
(58) Field of Search ..... 343/700 MS, 702, 343/895

(56) References Cited

U.S. PATENT DOCUMENTS 3,838,429 A * 9/1974 Reggia ..... 343/750
3,925,784 A * 12/1975 Phelan ..... 343/754
4,495,503 A 1/1985 Morman ..... 343/746
4,598,276 A * 7/1986 Tait ..... 340/572.5
5,313,216 A 5/1994 Wang et al. ..... 343/700 MS
5,608,417 A * 3/1997 de Vall ..... 343/895
5,790,080 A 8/1998 Apostolos ..... 343/744
6,064,351 A * 5/2000 Mandai et al. ..... 343/873
6,137,453 A 10/2000 Wang et al. ..... 343/895
6,166,694 A 12/2000 Ying ..... 343/702
6,353,420 B1 * 3/2002 Chung ..... 343/895
6,476,769 B1 * 11/2002 Lehtola ..... 343/702

* cited by examiner

*Primary Examiner*—Tho Phan
(74) *Attorney, Agent, or Firm*—John L. DeAngelis, Jr.; Beusse Brownlee Wolter Mora & Maire, P.A.

(57) ABSTRACT

An antenna incorporating slow wave structures. The antenna comprises at least two conductive serpentine structures disposed on a dielectric substrate and further comprising an oppositely disposed conductive top plate electrically connected to the conductive serpentine structures and farther electromagnetically connected thereto. In one embodiment the antenna further comprises a ground plane below the dielectric substrate.

30 Claims, 9 Drawing Sheets

WIDEBAND LOW PROFILE SPIRAL-SHAPED TRANSMISSION LINE ANTENNA

This application claims the benefit of the provisional patent application filed on Dec. 27, 2001, entitled Wide Band Low Profile Spiral Shaped Transmission Line Antenna and assigned application Ser. No. 60/344,255.

FIELD OF THE INVENTION

The present invention relates generally to antennas for receiving and transmitting radio frequency signals, and more specifically to a low profile wideband antenna including at least two spiral elements.

BACKGROUND OF THE INVENTION

It is generally known that antenna performance is dependent on the antenna size, shape and the material composition of certain antenna elements, as well as the relationship between the wavelength of the received/transmitted signal and antenna physical parameters (that is, length for a linear antenna and diameter for a loop antenna). These relationships and physical parameters determine several antenna performance characteristics, including: input impedance, gain, directivity, polarization and radiation pattern. Generally, for an operable antenna, the minimum effective electrical length (which for certain antenna structures, for example antennas incorporating slow wave elements, may not be equivalent to the antenna physical length) must be on the order of a quarter wavelength (or a multiple thereof) of the operating frequency. A quarter-wavelength antenna limits the energy dissipated in resistive losses and maximizes the energy transmitted. Quarter and half wavelength antennas are the most commonly used.

The radiation pattern of the half-wavelength dipole antenna is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical antenna gain is about 2.15 dBi.

The quarter-wavelength monopole antenna placed above a ground plane is derived from a half-wavelength dipole. The physical antenna length is a quarter-wavelength, but when disposed above a ground plane the antenna performance resembles that of a half-wavelength dipole. Thus, the radiation pattern for a quarter wavelength monopole antenna above a ground plane is similar to the half-wavelength dipole pattern, with a typical gain of approximately 2 dBi.

Printed or microstrip antennas are constructed using the principles of printed circuit board processing, where conductive layers on one or more dielectric substrates are patterned, masked and etched to form the antenna elements. The conductive layers or interconnecting vias serve as the radiating element(s). These antennas are popular because of their low profile, ease of manufacture and low fabrication cost.

One such antenna is the patch antenna, comprising in stacked relationship, a ground plane, a dielectric substrate, and a radiating element overlying the substrate top surface. The patch antenna provides directional hemispherical coverage with a gain of approximately 3 dBi. The patch antenna exhibits a relatively bandwidth and low radiation efficiency, i.e., the antenna exhibits relatively high losses within its radiation bandwidth. Patch antennas can be stacked or disposed in a single plane with a predetermined spacing therebetween to synthesize the desired radiation pattern that may not be achievable with a single patch antenna.

The common free space (i.e., not above a ground plane) conventional loop antenna, with a diameter of approximately one-third the operative wavelength, also displays the familiar omnidirectional donut radiation pattern along the radial axis, and exhibits a gain of about 3.1 dBi. At 1900 MHz the loop antenna has a diameter of about two inches. The typical loop antenna impedance is about 50 ohms, providing good matching characteristics to the feed transmission line.

The burgeoning growth of wireless communications devices and systems has created a need for physically smaller, less obtrusive and more efficient antennas that are capable of wide bandwidth and/or multiple resonant frequency operation. As the physical enclosures for pagers, cellular telephones and wireless Internet access devices shrink, manufacturers continue to demand improved performance, multiple operational modes and smaller sizes for today's antennas.

Smaller packaging envelopes may not provide sufficient space for the conventional quarter and half-wavelength antenna elements. Also, as is known to those skilled in the art, there is a direct relationship between antenna gain and antenna physical size. Increased gain requires a physically larger antenna, while users continue to demand physically smaller antennas.

Given the advantages and efficiencies of a quarter wavelength antenna, prior art antennas have typically been constructed with elemental lengths on the order of a quarter wavelength of the radiating frequency. These dimensions allow the antenna to be easily excited and to be operated at or near a resonant frequency, thereby limiting the energy dissipated in resistive losses and maximizing the transmitted energy. But, as the resonant frequency decreases, the resonant wavelength increases and the antenna dimensions also increase.

As a result, some antenna designers have turned to the use of so-called slow wave structures where the physical antenna dimensions do not directly represent the effective electrical length of the antenna element. As discussed above, but for the use of such slow wave structures, the antenna length must be on the order of a half wavelength to achieve the beneficial radiating properties. The use of a slow wave structure as an antenna element de-couples the conventional relationship between physical length and resonant frequency. The effective electrical length of the slow wave structure is greater than it's actual physical length, as shown in the equation below.

$$l_e=(\epsilon_{eff}^{1/2})\times l_p$$

where $l_e$ is the effective electrical length, $l_p$ is the actual physical length, and $\epsilon_{eff}$ is the dielectric constant ($\epsilon_r$) of the dielectric material on which the slow wave structure is disposed. Generally, a slow wave structure is defined as one in which the phase velocity of the traveling wave is less than the free space velocity of light. Slow wave structures can be used as antenna radiating and non-radiating elements.

A meanderline transmission line is one example of a slow wave structure, comprising a conductive pattern (i.e., a traveling wave structure) over a dielectric substrate, which in turn overlies a conductive ground plane. An antenna employing a meanderline structure, referred to as a meanderline-loaded antenna or a variable impedance transmission line (VITL) antenna, is disclosed in U.S. Pat. No. 5,790,080. The antenna consists of two vertical spaced-apart conductors and a horizontal conductor disposed therebetween, with a gap separating each vertical conductor from the horizontal conductor. The antenna further comprises a meanderline variable impedance transmission lines bridging the gap between the vertical conductor and each horizontal conductor. Generally, a meanderline structure is one comprising a non-linear or winding conductive element disposed over a dielectric substrate.

Using these meanderline structures, physically smaller antenna elements can be employed to form an antenna having, for example, quarter-wavelength characteristics, although the antenna physical dimensions are less than a quarter-wavelength. Although the meanderline-loaded antenna offers desirable attributes within a smaller physical volume, as hand-held wireless communications devices continue to shrink, manufacturers continue to demand even smaller antennas, especially those that are easily conformable into the available volume. Meanderline-loaded antennas, such as those set forth in the above referenced patent, are typically not easily conformable. Also, the antenna should desirably exhibit wide-bandwidth performance or have one or more resonant frequencies (thus having the effect of wide bandwidth performance). Further, the antenna must exhibit the radiation pattern required by the intended application. The prior art meanderline antennas may not generally exhibit these characteristics.

BRIEF SUMMARY OF THE INVENTION

The antenna of the present invention comprises a dielectric substrate overlying a slow wave transmission line structure. In one embodiment a top conductor overlies the dielectric substrate and is connected to the slow wave transmission line structure by at least two conductive vias extending through the dielectric substrate. Various shaped top conductors and slow wave transmission structures are employed in the antenna according to the teachings of the present invention.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
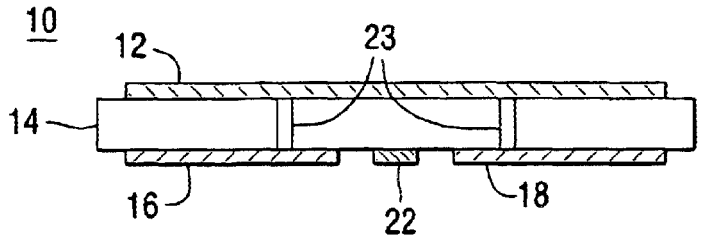
FIG. 1 is a side view of an antenna constructed according to the teachings of the present invention.

Before describing in detail the particular spiral antenna in accordance with the present invention, it should be observed that the present invention resides primarily in a novel combination of hardware elements related to an antenna. Accordingly, the hardware elements have been represented by conventional elements in the drawings, showing only those specific details that are pertinent to the present invention, so as not to obscure the disclosure with structural details that will be readily apparent to those skilled in the art having the benefit of the description herein.

The antenna of the present invention is small enough to be installed within or in contact with the case of a wireless handset communications device. In one embodiment, the thickness of the antenna is less than about $\lambda/200$ and the length and width less than about $\lambda/5$. In one embodiment the antenna exhibits more than a 10% bandwidth at one or more resonant frequencies. This would generally be considered a relatively wide bandwidth antenna, and a wider bandwidth than is achievable with prior art patch or microstrip antennas. Because the antenna is constructed of conductive traces on a dielectric substrate, printed circuit board manufacturing technologies can be utilized to relatively inexpensively and efficiently manufacture antennas according to the teachings of the present invention. Finally, the antenna has equal or better gain and directivity performance when compared to prior art dipole and monopole antennas.

In one embodiment the antenna dimensions are as follows:

Antenna size: 1.3" width ($\lambda/4.8$)×0.8" length ($\lambda/7.8$)× 0.03" height ($\lambda/207$)

Resonant frequency: 1.9 GHz (within the personal communications (PCS) band)

Bandwidth: 200 MHz at 1.9 GHz (about 10.5% of the center frequency)

Gain: 3.65 dBi

FIG. 1 is a cross-sectional view of an antenna 10 constructed according to the teachings of the present invention. The antenna 10 comprises a top plate 12 overlying a dielectric substrate 14, with two spiral conductors 16 and 18, which are slow wave structures, disposed on a bottom surface of the dielectric substrate 14. Thus the effective electrical length of the slow wave structures is governed by the equation set forth above, and is greater than their physical length. A feed terminal 22, formed by a terminal end of the spiral conductor 18, is also disposed on the bottom surface of the dielectric substrate 14. Two vias 23 are also illustrated as electrically connecting the top plate 12 and the two spiral conductors 16 and 18. The top plate 12 and the spiral conductors 16 and 18 are also electromagnetically coupled due to their proximate disposition. Although the antenna of the present invention as illustrated in FIG. 1 is described as comprising one or more spiral conductors, this description is not intended to limit the slow wave structures to only those having a conventional spiral shape, as the slow wave structures can comprise any serpentine or sinuous shape. Generally, both the top plate 12 and the spiral conductors 16 and 18 radiate electromagnetic energy when the antenna 10 is in the transmitting mode.

Figure 2:
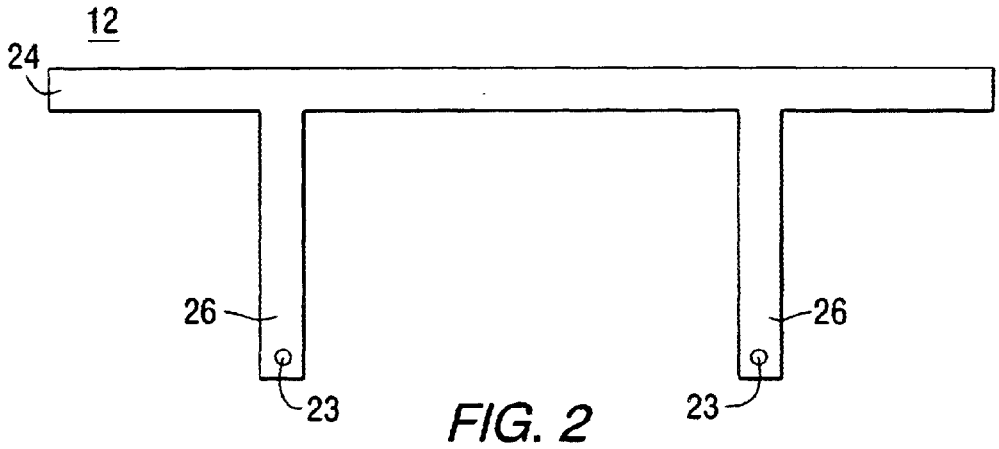
FIGS. 2 and 3 are plan views of two elements of the antenna of FIG. 1.
Figure 3:
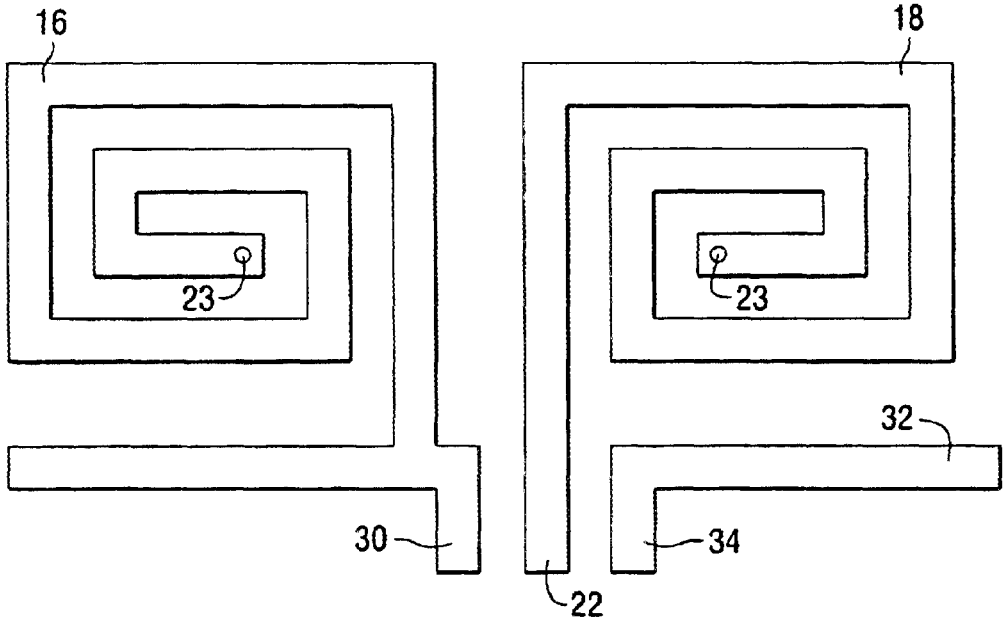

One embodiment shape for the top plate 12 is illustrated in FIG. 2, comprising an elongated segment 24, including a segment 25 between two arms 26. One embodiment for the spiral conductors 16 and 18 is illustrated in FIG. 3. Note that in the transmitting mode a current representing the signal to be transmitted flows from the feed terminal 22 (typically connected directly to a coaxial cable connector or to a conductive printed circuit board trace carried on a dielectric substrate to which the antenna 10 is physically mounted) along the spiral conductor 18 to the via 23, then to the top plate 12. The current flows along one arm 26 and the segment 25, and then through the via 23 to the spiral conductor 16 to a terminal 30 connected to ground (i.e., the ground sheath of the coaxial cable connector or the ground plane of the printed circuit board). A conductive element 32 is also connected to ground at a terminal 34, and electromagnetically coupled to the spiral conductor 18 due to the proximate physical relationship therebetween. A conductive element 33 extending from the spiral conductor 16 electromagnetically interacts with proximate regions of the spiral conductor 16.

Modifying the distance between the conductive element 33 and the spiral conductor 16 and/or the distance between the conductive element 32 and the spiral conductor 18, and/or the physical or effective electrical length of the spiral conductors 16 and 18 (and the length of the conductive element 33), and/or the dielectric material of the dielectric substrate 14 changes the antenna performance parameters. In another embodiment the spiral conductors 16 and 18 can be constructed with unequal lengths to provide a wider operational bandwidth or two operational resonant frequencies.

Figure 4:
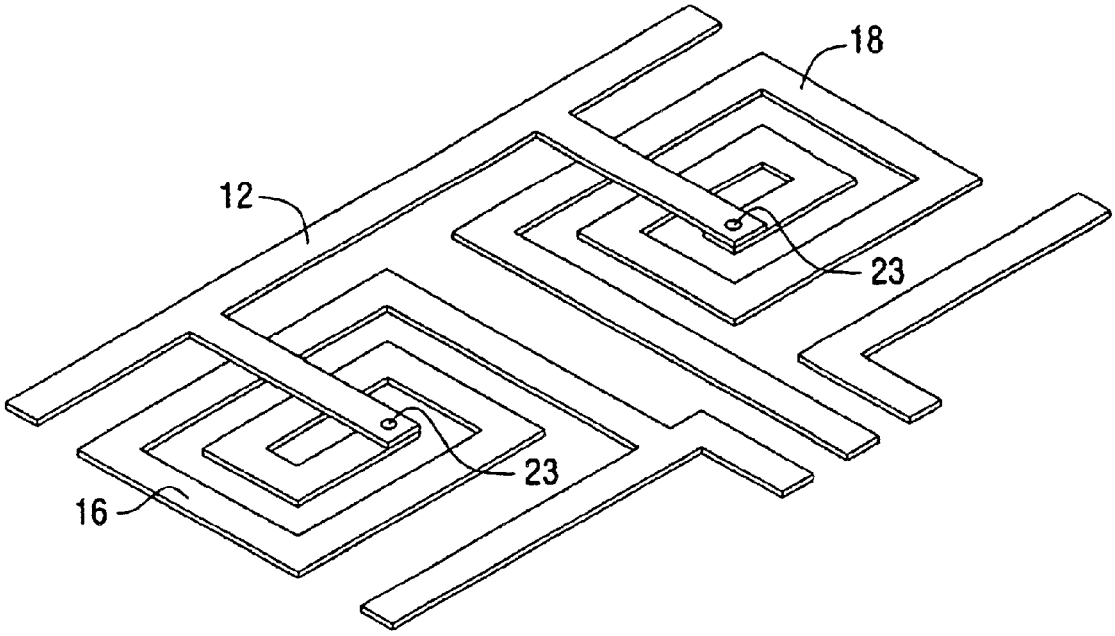
FIG. 4 is a perspective view of the antenna of FIG. 1.

FIG. 4 is a perspective view of the various elements of the antenna 10 described above, absent the dielectric substrate 14.

The resonant frequency of the antenna 10 is determined primarily by the total effective electrical length of the spiral conductors 16 and 18. Where the effective electrical length of these slow wave structures is governed by the equation set forth above. Advantageously, the spiral conductors 16 and 18 present a good impedance match (about 50 ohms) over a wide bandwidth. Adjusting the spacing between segments of the spiral conductors and modifying the line widths changes the input impedance characteristics. The use of the slow wave structures in the form of the spiral conductors 16 and 18 allows the antenna 10 to present a relatively small physical size.

Figure 5:
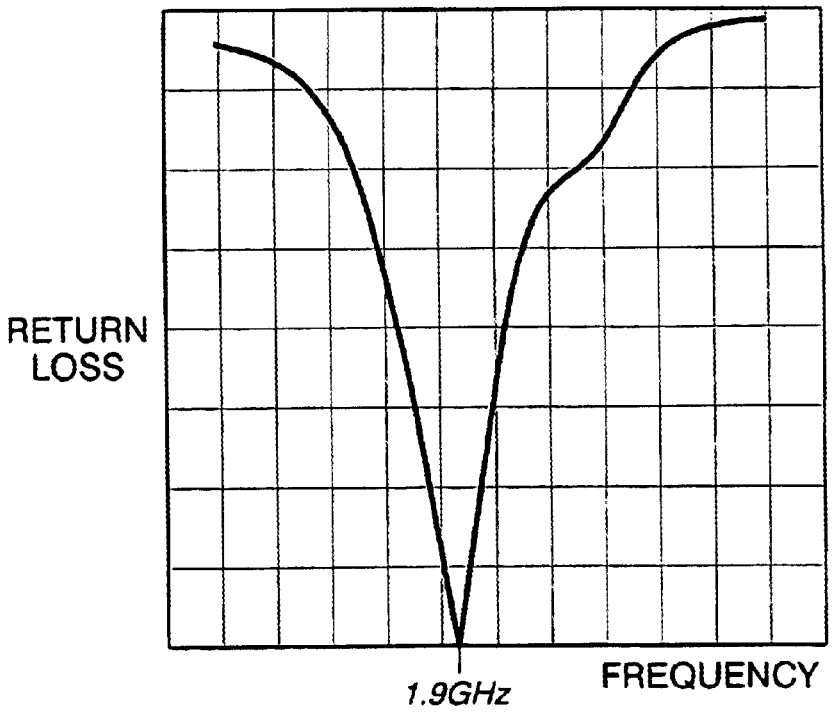
FIG. 5 is a return loss graph for one embodiment of an antenna constructed according to the teachings of the present invention.

FIG. 5 is a graph of the input return loss for the antenna 10. The return loss is also referred to as $S_{11}$, which is a measure of the power delivered to the antenna from the input transmission line versus the power reflected back from the antenna, where the power loss is due to the impedance mismatches between the antenna and the input transmission line. As can be seen, the minimal return loss is at about 1.9 GHz. Generally, the operational bandwidth of the antenna is considered to be that range of frequencies where the return loss is within about 10 dB of the minimum return loss value. Thus in FIG. 5, the bandwidth is about 300 MHz, which is considered a wide operational bandwidth, considering that the resonant or center frequency of the band is at about 1.9 GHz.

Figure 6:
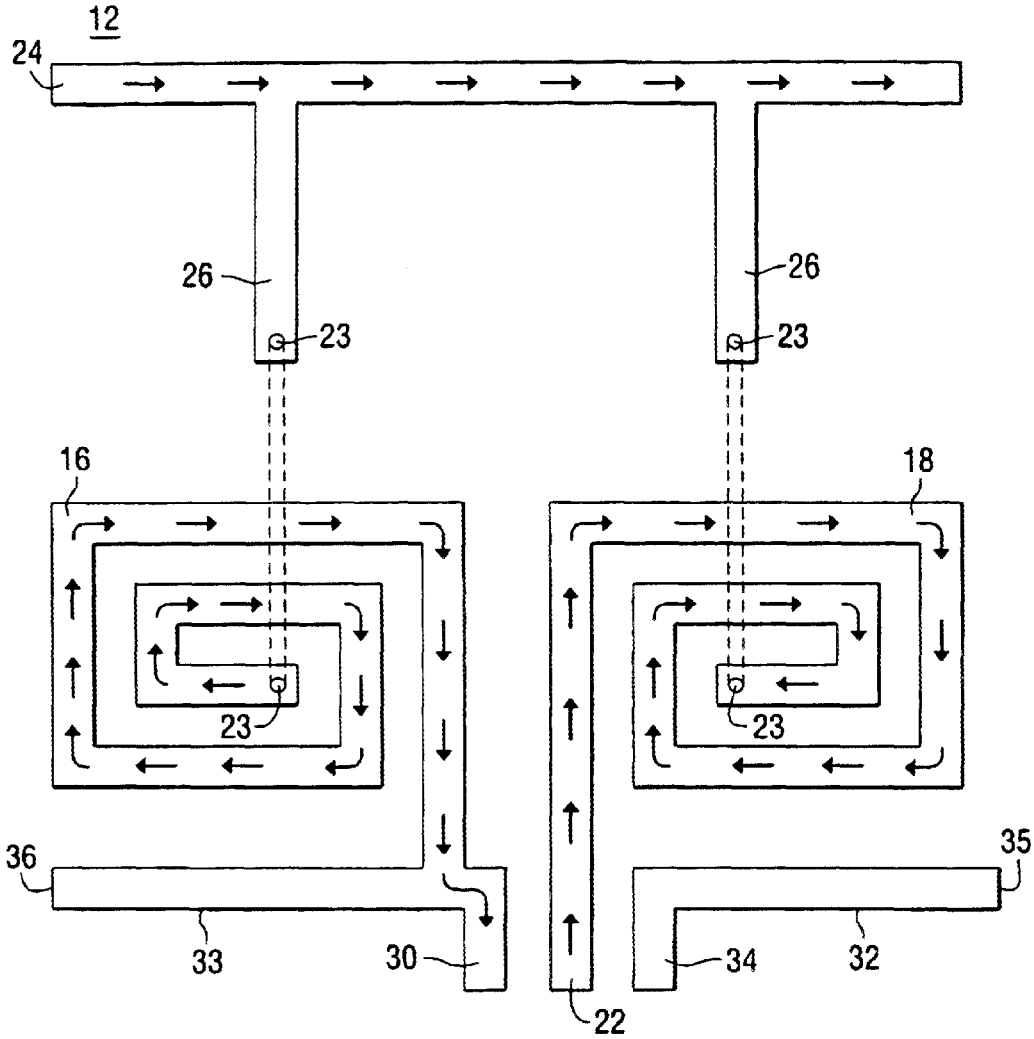
FIG. 6 is a representational view of current flow through the antenna elements of FIGS. 2 and 3.
Figure 7:
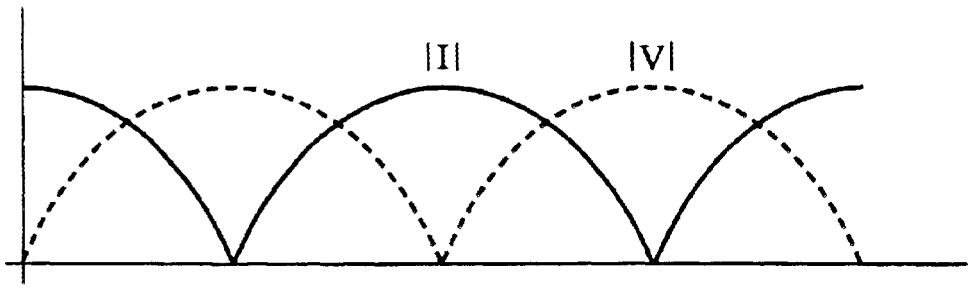
FIG. 7 is a graph of the current distribution of FIG. 6.

FIG. 6 illustrates the current flow paths for the various elements of the antenna 10. Note that the orientation, direction and feed/ground positions of the spiral conductors 16 and 18 provides for the same current flow direction in radially adjacent arms or segments of the spiral conductors 16 and 18, thus minimizing the radiation canceling effects and increasing the antenna gain. Avoidance of these canceling effects is especially advantageous given the small physical size of the antenna. Since the terminal 30 is connected to ground, the voltage is minimum and the current is a maximum there. Recognizing these boundary conditions, the current and voltage magnitude waveforms for the antenna 10 are graphed in FIG. 7, assuming for the sake of simplicity, that the total electrical length of the antenna 10 (defined as the electrical lengths of the spiral conductors 16 and 18 plus the electrical length of the segment 25) is about one wavelength at the operating frequency. Thus the current and voltage values proceed through one cycle over the antenna length, with the voltage at a minimum at an edge 35 of the conductive element 32, at an edge 36 of the conductive element 33 and at the terminal 30 connected to ground.

Figure 8:
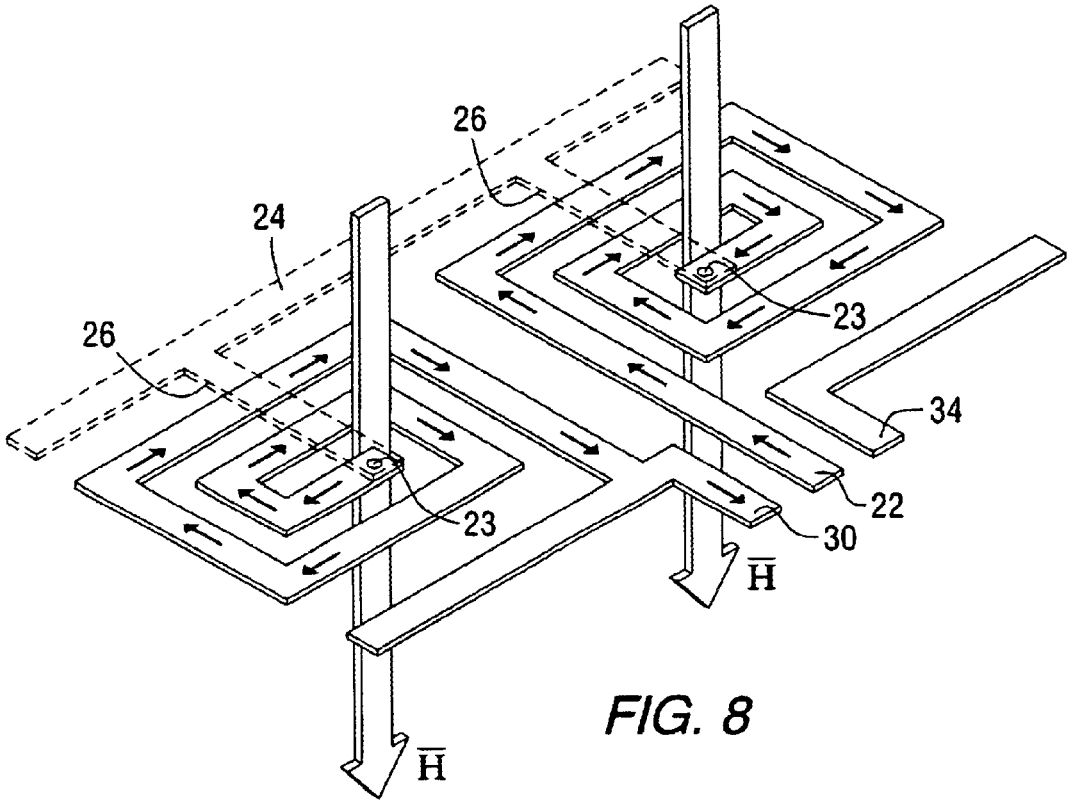
FIG. 8 illustrates the magnetic field of an antenna constructed according to the teachings of the present invention.

FIG. 8 illustrates the magnetic fields (H) created by the current flowing in the spiral conductors 16 and 18, as derived based on the right hand rule for defining the relationship between the current flow in the spiral conductors 16 and 18 and the direction of the magnetic field. Thus in this embodiment, the spiral conductors 16 and 18 serve as radiating sources and as transmission lines. The electric field, not shown, is perpendicular to the magnetic field.

Note that because of the same-direction currents in the spiral conductors 16 and 18, (as shown in FIG. 6) the magnetic fields generated in the spiral conductors 16 and 18 are additive in the far field; the electric fields are also additive. Further, the electric field formed by the current flow in the top plate 12 is parallel to and thus sums with the electric field formed by the magnetic fields generated by the current flow in the spiral conductors 16 and 18. The radiation emitted from the antenna 10 is linearly polarized due to the linear electric field.

Generally, the radiation pattern of the antenna 10 is the familiar donut pattern associated with a conventional dipole antenna. The antenna 10 is in the donut "hole" and the donut ring surrounds the antenna 10.

Figure 9:
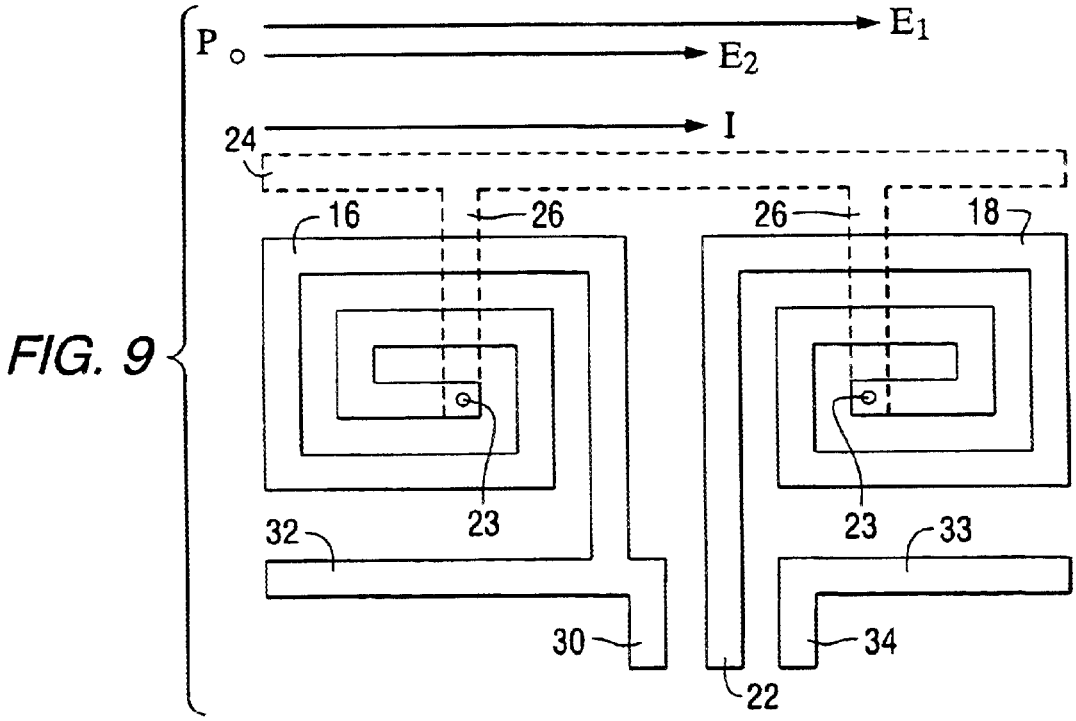
FIG. 9 illustrates the electric fields associated with the antenna of the present invention.

FIG. 9 further illustrates the additive electric fields formed by the antenna 10 at a point P in the far field. The current I in the top plate 12 creates an electric field $E_2$ in the far field. The electric field $E_1$ is created by the magnetic field illustrated in FIG. 8. Thus the total electric field at P is the sum of $E_2$ and $E_1$. Since these fields are parallel, the vector sum is maximized, i.e., the fields add constructively. Notwithstanding the relatively small physical size, the antenna 10 has a high efficiency, about 70%, as determined by the radiated power versus the input power.

Figure 10:
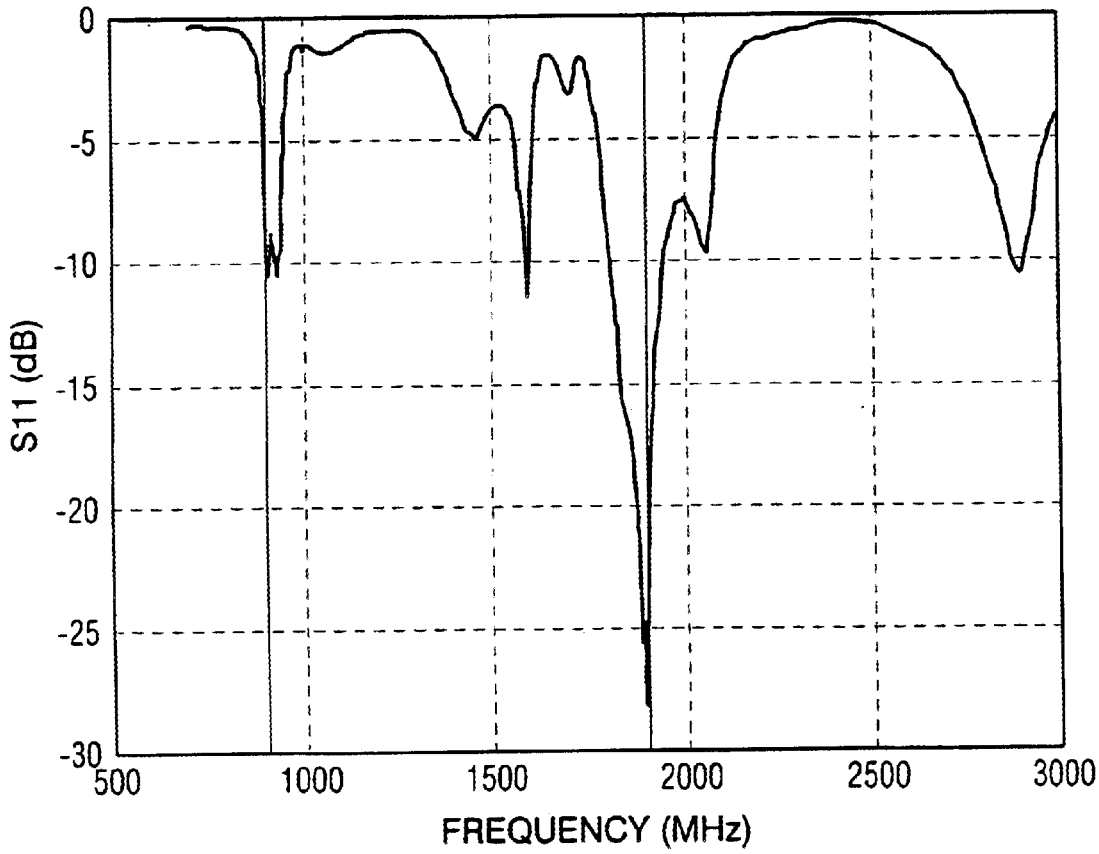
FIG. 10 is a graph of the return loss for another embodiment of an antenna constructed according to the teachings of the present invention.

An alternative embodiment wherein the antenna dimensions are about 1.8"×1.1"×0.03" deep, also exhibits advantageous performance parameters. In this embodiment, the 1.8" dimension is the side parallel to the top plate 12. The input impedance characteristics for this embodiment, as characterized by the input return loss, are illustrated in FIG. 10.

Figure 11:
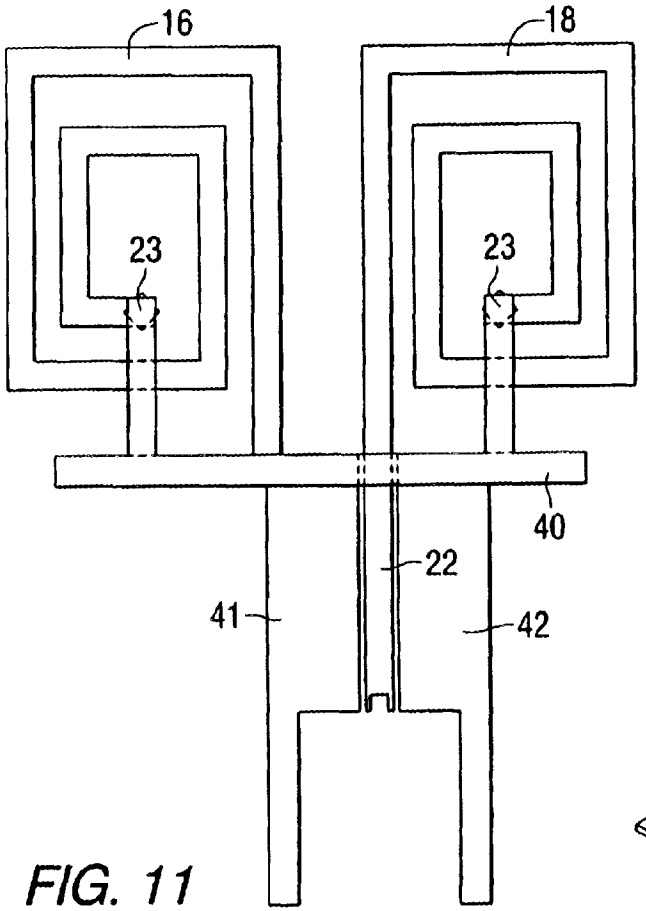
FIGS. 11 and 12 illustrate another embodiment of an antenna constructed according to the teachings of the present invention.
Figure 12:
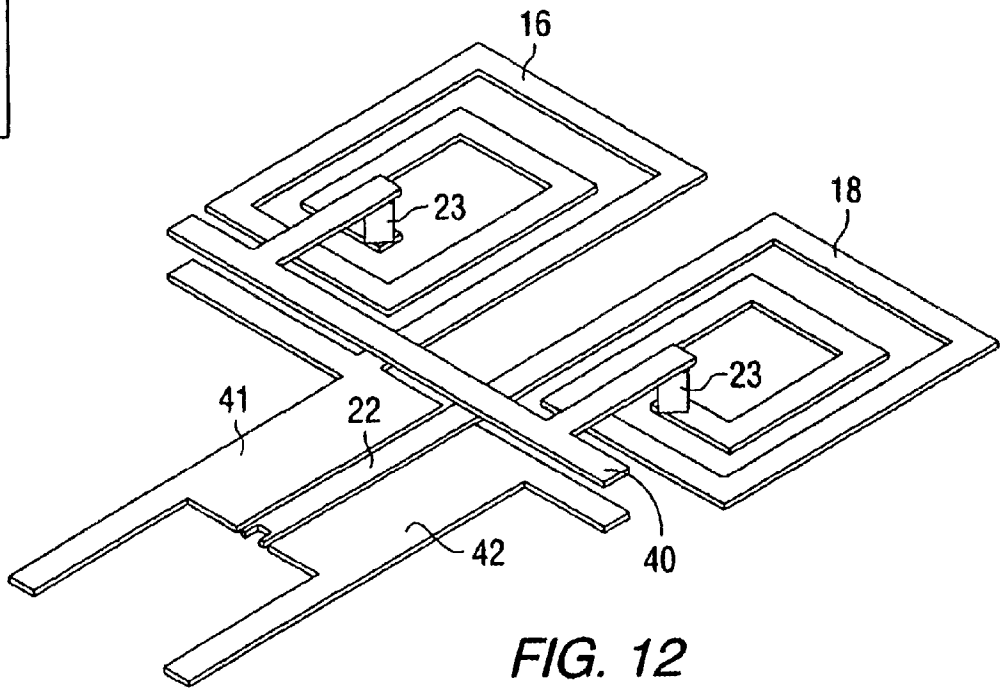

Another embodiment according to the present invention is illustrated in FIG. 11 by an antenna 39, wherein a top plate 40 is located proximate the spiral conductors 16 and 18, and disposed relative thereto oppositely to the top plate 12 as illustrated in FIG. 4. A perspective view of the antenna 39 is illustrated in FIG. 12, with the top plate 40 in a plane above the spiral conductors 16 and 18. The antenna 39 further comprises conductive segments 41 and 42 on opposite sides of the feed terminal 22, both or which are connected to ground when the antenna 39 is installed in a communications device.

Additional embodiment shapes for the spiral conductors 16 and 18 are illustrated in FIGS. 13 through 18. These shapes can be employed with any of the antenna embodiments described herein. Each of the FIGS. 13 through 18 presents a bottom view of the antenna 10 and thus the top plate 12 is shown in phantom. The feed terminal 22 and the terminals 30 and 34, the latter two which are typically connected to ground, are also illustrated. Generally, these additional embodiments provide higher resonant frequencies as a function of the increased spiral length. Further, if a third spiral shaped element is added, an additional resonant frequency is created. With three or more spirals, wider bandwidth operation can be realized if the antenna resonant frequencies are closely spaced such that the operational bandwidths associated with the resonant frequencies are proximate or overlap. The additional resonant frequencies are determined by the shape, size (i.e., length and width dimensions of the spiral conductors) and interconnections to the top plate 12.

Figure 13:
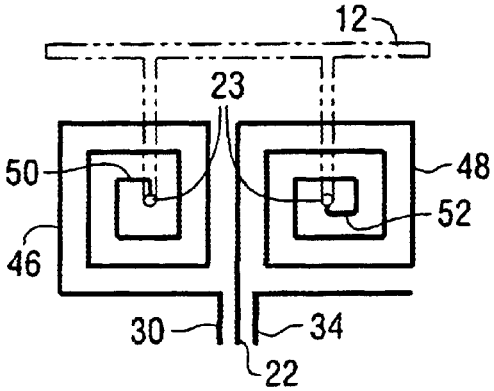
FIGS. 13–18 illustrate various embodiments of spiral and serpentine conductors suitable for use with the various antennas of the present invention.

FIG. 13 illustrates spiral conductors 46 and 48 both wound in a counter-clockwise direction, compared to the counter-wound spiral conductors 16 and 18. Also, the initial segments of the spiral conductors 46 and 48 extend in opposite directions, that is the initial segment 50 of the spiral conductor 46 extends toward the top plate 12, whereas the initial segment 52 of the spiral conductor 48 extends away from the top plate 12. Note that the initial segments of the spiral conductors 16 and 18 are mirror images through a plane passing between the spiral conductors 16 and 18. This is not the case for the spiral conductors 46 and 48. Generally, the counter-wound spirals (FIG. 3, for example) have a main beam radiation maximum that is approximately perpendicular to the plane of the antenna, whereas the radiation maximum of the FIG. 13 embodiment is shifted from the nadir to an angle less than 90 degrees. In one embodiment this angle is between about 45 and 50 degrees. The embodiment of FIG. 3 and the embodiment of FIG. 13 exhibit approximately the same operational bandwidth.

One clockwise-wound and one counterclockwise-wound antenna can be incorporated into the antenna of a wireless communications device to provide antenna diversity with regard to the beam pattern, while each antenna advantageously operates over approximately the same signal bandwidth.

Although the spiral conductors described herein are illustrated as generally comprising rectangular linear segments or arms, which are typically easier to manufacture and can be fabricated in smaller geometries, curved spiral conductors can also be used according to the teachings of the present invention. See FIG. 14. The use of curved spirals affords higher operational efficiency since there are no sharp corners in the antenna structure for creating reflections and attendant losses.

Figure 15:
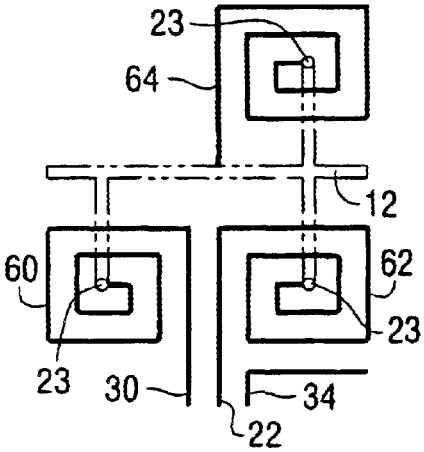

The embodiment of FIG. 15 includes two spiral conductors 60 and 62, similar to the spiral conductors 16 and 18, and a third spiral conductor 64, that provides an additional resonant frequency for the antenna and further can be switched into or out of the antenna circuit as desired. The switching function can be accomplished by, for example, a pin diode or a MEMS (microelectronics machine structure) switch (not shown in FIG. 15).

Figure 16:
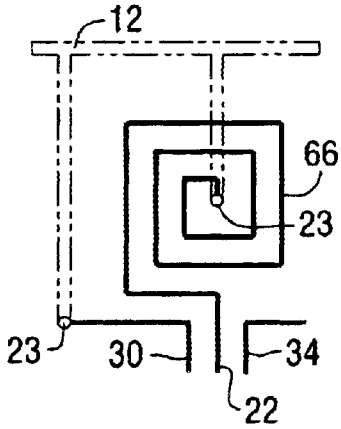
Figure 14:
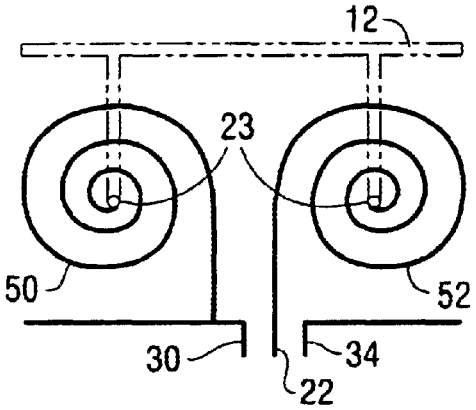

FIG. 16 depicts an embodiment with one spiral conductor 66 and the terminal 30 connected to one arm 26 of the top plate 12 by the via 23.

Figure 17:
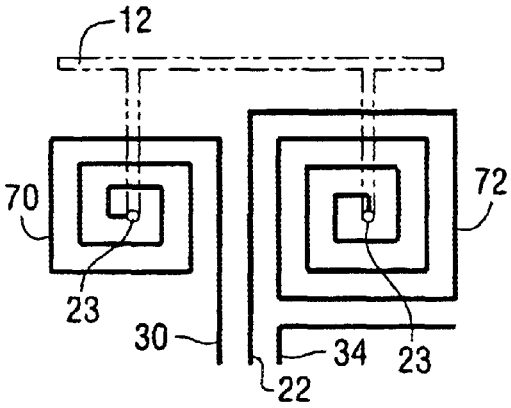

FIG. 17 illustrates two differently-sized spiral conductors 70 and 72, exhibiting the same relative spiral orientation as the spiral conductors 16 and 18. This embodiment offers a wider operational bandwidth (or operation over two separate frequency bands) than the embodiment of FIG. 3.

Figure 18:
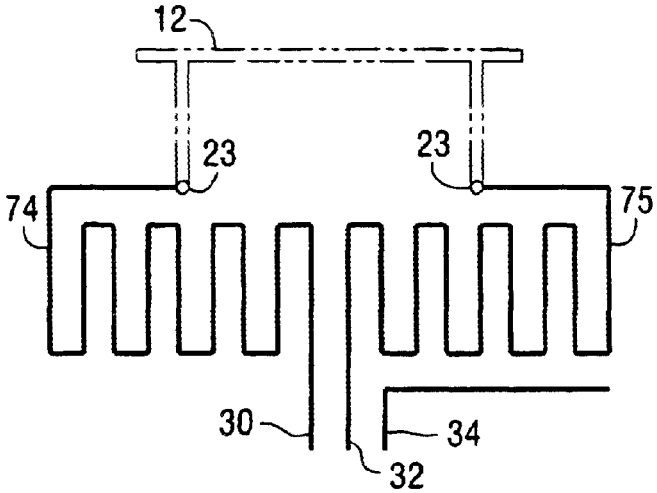

FIG. 18 illustrates zigzag shaped conductors 74 and 75 for use with the antenna 10. As expected, antenna performance using the conductors 74 and 75 differs from the performance with the various spiral-shaped conductors described herein, as the zigzag conductor arrangement produces different electric and magnetic fields than the spiral-shaped conductors. The embodiment of FIG. 18 is merely illustrative of a shape where the physical outline of the conductors is relatively compact, and the effective electrical length is greater than the physical length due to the slow wave structural effects.

Figure 19:
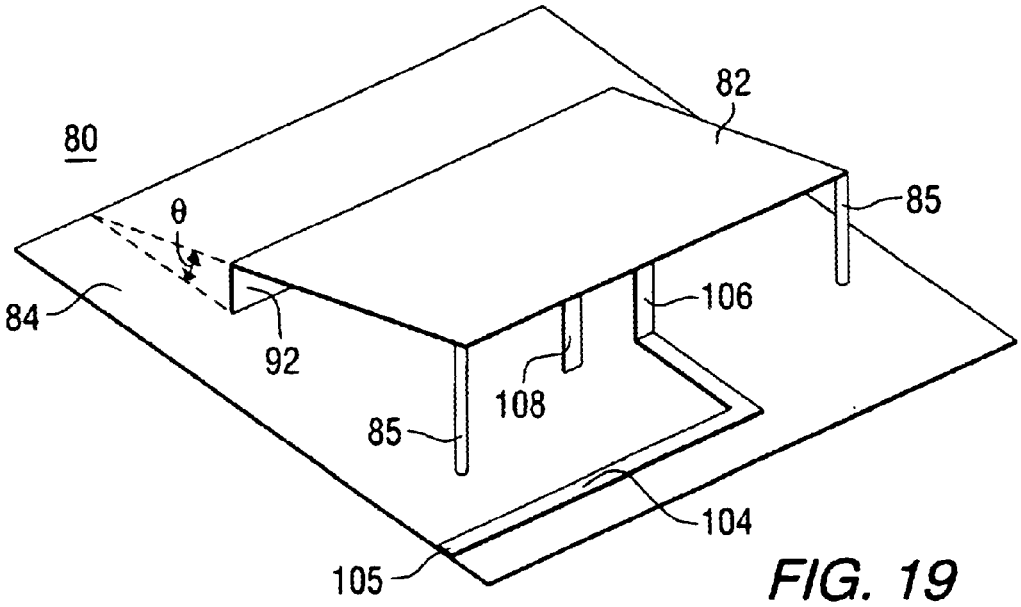
FIG. 19 is a perspective view of an antenna constructed according to another embodiment of the present invention.

FIG. 19 illustrates an antenna 80 constructed according to another embodiment of the teachings of the present invention, comprising an element 82 disposed over a ground plane 84. As will be described further below, the element 82 comprises spiral conductors on the bottom surface thereof and a conductive plate on the top surface. The angle of intersection, $\theta$, between the plane of the element 82 and the ground plane 84 is selectably adjustable to change the antenna resonant frequency. For instance, if the element 82 is perpendicular to the ground plane 84 ($\theta$=90°), then the antenna 80 has a resonant frequency of about 2.4 GHz. If $\theta$ is about 70°, then the resonant frequency is about 1.9 GHz. If the plane of the element 82 and the ground plane 84 are substantially parallel, then the resonant frequency is about 1.7 GHz.

A front and/or back edge of the element 82 is mechanically connected to the ground plane 84 by a dielectric standoff, such as insulating pins 85. In a preferred embodiment neither the front nor the back edge of the element 82 is in contact with the ground plane 84, but instead is spaced apart therefrom. In another embodiment, the antenna 80 further comprises an adjustable member (for example in lieu of the insulating pins 85) for exerting a controllable force to change the distance between the ground plane 84 and the element 82 and/or the angle $\theta$, thereby imparting frequency agile capabilities to the antenna 80.

The radiation pattern of the antenna 80 is somewhat omnidirectional (i.e., the donut pattern), however, the ground plane 84 causes additional energy to be radiated in the vertical direction than the conventional omnidirectional donut pattern. Further, as the ground plane size is increased relative to the size of the element 82, additional energy is radiated in the vertical direction.

Figure 20:
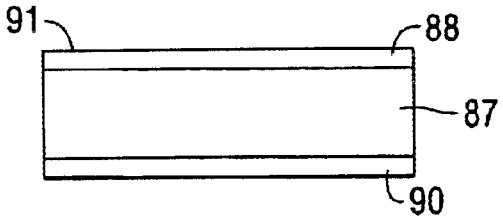
FIG. 20 is a side view of the radiating element of FIG. 18 embodiment.

The element 82 comprises a conductive-clad dielectric substrate 87 having an upper surface 88 and a lower surface 90. See the detailed enlarged view of FIG. 20. In the preferred embodiment, a continuous conductive plate 91 overlies the upper surface 88. In other embodiments the conductive plate 91 can be shaped and dimensioned, according to known patterning, masking and etching processes, to provide the desired antenna performance parameters.

Figure 21:
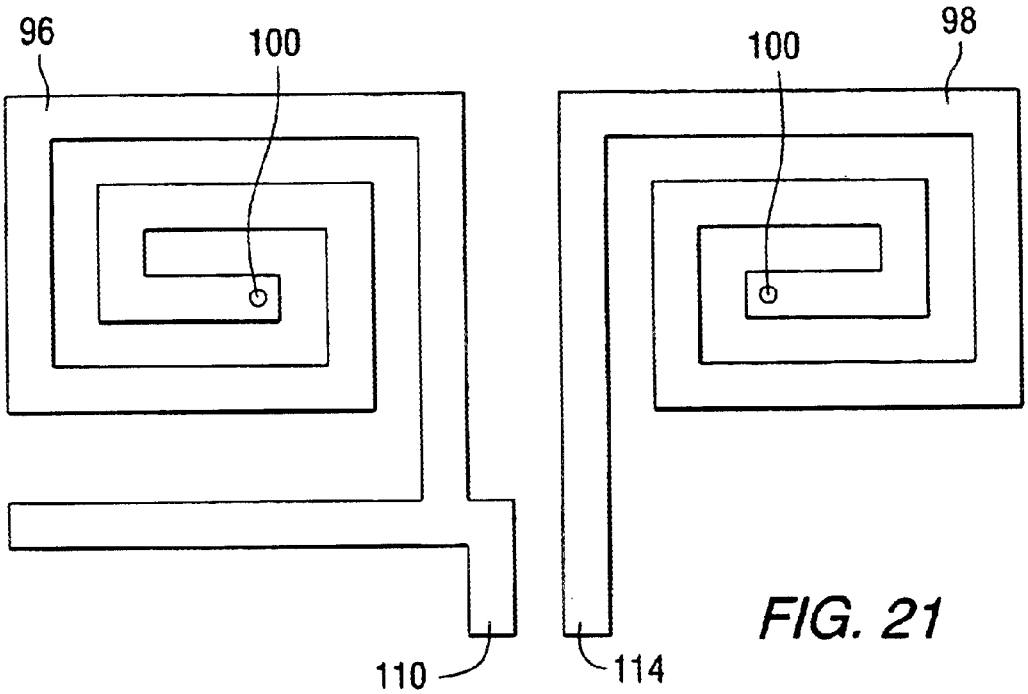
FIG. 21 is a plan view of the spiral conductive elements for use with the antenna embodiment of FIG. 18.

A serpentine conductor, including one of the many conductive spiral patterns described, above is disposed on the lower surface 90. FIG. 21 illustrates two such spiral conductors 96 and 98. Conductive vias 100 formed within the dielectric substrate 87 connect the conductive plate 91 to a terminal end of each of the spiral conductors 96 and 98. The spiral conductors 96 and 98 are also electromagnetically coupled to the conductive plate 91. In the transmitting mode, the majority of the energy is radiated from the conductive plate 91, with a lesser amount radiated from the spiral conductors 96 and 98. Changing the geometric characteristics (e.g., length, conductor width, spacing of adjacent spiral turns within a spiral conductor (also referred to as the spiral tightness), spacing between the two spiral conductors) of the spiral conductors 96 and 98 changes the resonant frequency and bandwidth of the antenna 80. Thus the spiral conductors 96 and 98 serve as tuning elements for the antenna 80. Additionally, as described above, changing the angle θ changes the coupling effects between the spiral conductors 96 and 98 and the ground plane 84, changing the antenna performance parameters, especially the resonant frequency.

Returning to FIG. 19, typically the ground plane 84 is disposed on a dielectric substrate (not shown) that also supports other electronic components operating in conjunction with the antenna 80, such as a radio frequency module. The substrate also supports a signal or feed trace 104 (insulated from the ground plane 84) for supplying a signal to the element 82 in the transmitting mode and for receiving a signal from the element 82 in the receiving mode. A coaxial cable connector (not shown) or another connector type is electrically connected to a terminal end 105 the signal trace 104. The other terminal end of the signal trace 104 is connected to one of the spiral conductors 96 or 98 by a feed pin 106. A ground pin 108 connects the appropriate terminal of one of the spiral conductors 96 or 98 to the ground plane 84.

In an embodiment where the element 82 is parallel to the ground plane 84 (θ=0°), the distance between the element 82 and the ground plane 84 is about 1 to 3 mm. The antenna of this embodiment has a resonant frequency of about 1.9 GHz, with a bandwidth ranging from about 1.85 to about 1.99 GHz (i.e., the antenna operates within the personal communications band (PCS) frequency band). The voltage standing wave ratio in this frequency range is less than about 3:1.

The spiral conductors 96 and 98 would generally not be considered radiating elements in this embodiment, but their electromagnetic coupling to the ground plane 84 advantageously affects the antenna performance parameters. Also, it is generally known that a radiating structure disposed close to a ground plane exhibits a relatively narrow bandwidth. However, the electromagnetic coupling effect created between the spiral conductors 96 and 98 and the ground plane 84 provides the antenna 80 with a tuning capability to increase the operational bandwidth or create more than one resonant frequency. The wider bandwidth can be advantageous to overcome the well-known hand effect, i.e., a change in antenna performance characteristics due to the capacitive coupling between the user's hand and the antenna. The hand effect is known to shift the resonant frequency of the antenna, but if that shift remains within the operational bandwidth, then the hand effects are minimized. Adjusting the geometric parameters of the spiral conductors 96 and 98 also influences the antenna performance parameters.

Figure 22:
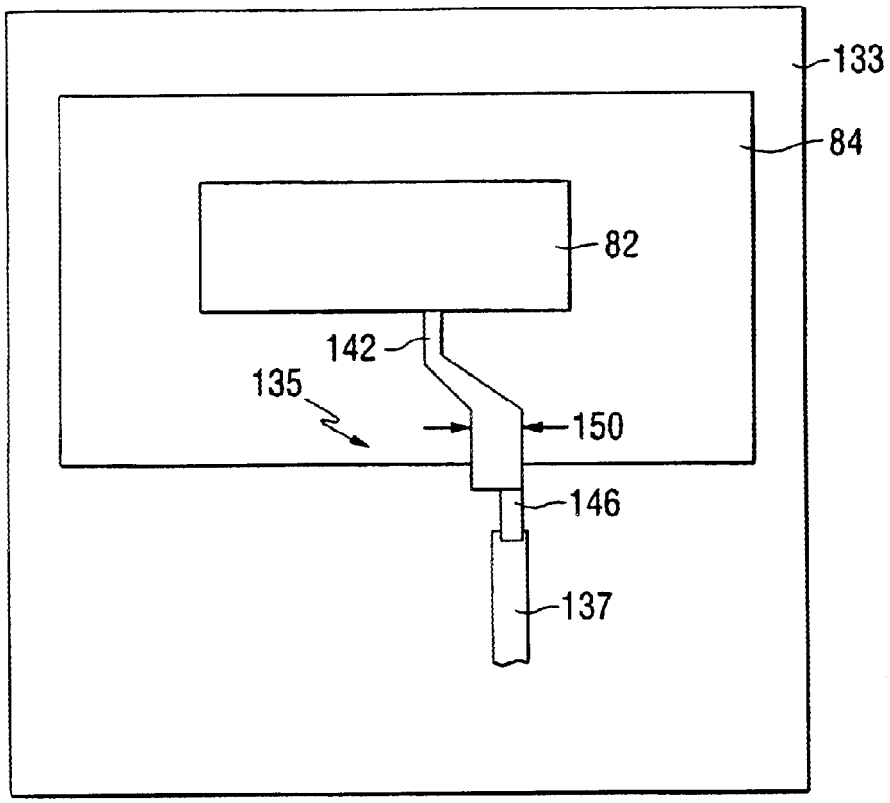
FIGS. 22, 23 and 24 are various views of a feed line for use with the antenna embodiment of FIG. 19.
Figure 23:
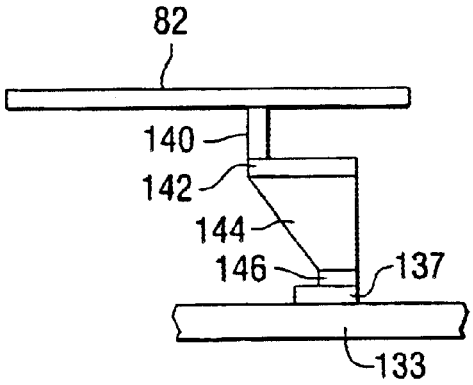
Figure 24:
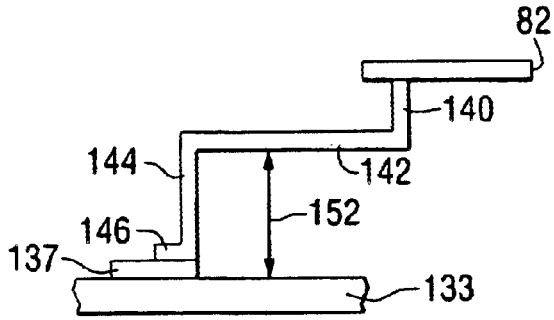

In another mounting configuration, the antenna 80 is disposed above a printed circuit board 133, for example using the insulating pins 85 illustrated in FIG. 19. A feed line 135 extending from the element 82 and illustrated in FIG. 22 (top view), 23 (front view) and 24 (side view), electrically connects the terminal 114 (see FIG. 21) to a feed trace 137 disposed on the printed circuit board 133. A segment 140 of the feed line 135 extends substantially vertically downwardly, connecting to a substantially horizontal segment 142. A substantially vertical segment 144 interconnects the horizontal segment 142 to a pad interface segment 146. The dimensions 150 (see FIG. 22) and 152 (between the printed circuit board 133 and the horizontal segment 142) are particularly important for maintaining low loss within the feed line 135 and thus must be optimized for the antenna operational frequency and bandwidth. Thus the feed line 135 connects the feed trace 137 to the radiating element of the antenna 80 (in this embodiment the conductive plate 91 of the element 82) via the spiral conductor 98.

The ground terminal 110 of FIG. 21 is connected to the ground plane 84 by a substantially vertical conductive element or pin (not shown). In turn the ground plane 84 is electrically connected to a ground plane (not shown) disposed on the printed circuit board 133 by known techniques.

With respect to the various spiral slow wave structures presented herein, in another embodiment the slow wave structure includes independently switchable segments that can be inserted in and removed from the current path of the slow wave structure. This switching action provides an adjustment mechanism for the effective electrical length of the slow wave structure and thus changes the effective length and the performance characteristics of the antenna. Advantageously, losses are minimized during the switching process by locating the switching element in a high impedance section of the meanderline. Thus the current through the switching device is low, resulting in relatively low dissipation losses and a high antenna efficiency.

In the various embodiments presented herein, the conductive regions (e.g., the spiral-shaped conductors and the conductive plate) can be formed from a conductive-clad dielectric substrate by using known patterning, masking and etching steps. Thus fabrication of the various antenna embodiments presented herein can be accomplished relatively easily and thus relatively inexpensively when compared with other antenna designs offering comparable performance.

While the invention has been described with reference to preferred embodiments, it will be understood by those skilled in the art that various changes may be made and equivalent elements may be substituted for elements of the various embodiments without departing from the scope of the present invention. The scope of the present invention further includes any combination of the elements from the various embodiments set forth herein. In addition, modifications may be made to adapt a particular situation to the teachings of the present invention without departing from its essential scope. For example, different combinations of the spiral conductors presented herein can be utilized to accommodate the requirements of a communications device. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a dielectric substrate;

a slow wave structure disposed on a first surface of the dielectric substrate and having a feed terminal;

a conductive element disposed on the first surface proximate the feed terminal and conductively isolated from the slow wave structure;

a top conductor disposed on a second surface, opposing the first surface of the dielectric substrate; and a conductive via extending through the dielectric substrate for connecting the slow wave structure to the top conductor.

2. The antenna of claim 1 wherein the slow wave structure comprises at least one conductor having a spiral shape.

3. An antenna comprising:

a dielectric substrate;

a slow wave structure disposed on a first surface of the dielectric substrate;

a top conductor disposed on a second surface, opposing the first surface of the dielectric substrate; and a first and a second conductive via disposed within the dielectric substrate and electrically connected to the top conductor, wherein the slow wave structure comprises a first and a second conductor each having a serpentine shape, and wherein a first end of the first conductor is connected to the first conductive via, and wherein a first end of the second conductor is connected to the second conductive via, and wherein a second end of the first conductor is a ground terminal for the antenna, and wherein a second end of the second conductor is a signal terminal for the antenna.

4. The antenna of claim 3 wherein the serpentine shape is selected from among a spiral comprising linear arms, a spiral comprising curved arms, a meandering shape, a sawtooth wave shape and a square wave shape.

5. The antenna of claim 3 wherein the top conductor comprises an elongated segment having a first and a second arm extending in the same direction therefrom, and wherein the first conductive via is positioned at an end of the first arm and the second conductive via is positioned at the end of the second arm.

6. The antenna of claim 3 wherein the serpentine shape comprises a spiral-shape, and wherein the current flow is in the same direction through radially adjacent spiral arms of the first conductor, and wherein the current flow is in the same direction through radially adjacent spiral arms of the second conductor.

7. The antenna of claim 6 wherein the first and the second conductors comprise opposingly wound spirals.

8. The antenna of claim 7 wherein the magnetic fields produced by the current flow through the first and the second conductors add constructively in the far field.

9. The antenna of claim 8 wherein a first electric field is produced by the sum of the magnetic fields, and wherein a current flow through the top conductor produces a second electric field, and wherein the first and the second electric fields add constructively in the far field.

10. An antenna comprising:

a dielectric substrate;

a slow wave structure disposed on a first surface of the dielectric substrate;

a top conductor disposed on a second surface, opposing the first surface of the dielectric substrate;

a conductive via extending through the dielectric substrate for connecting the slow wave structure to the top conductor; and wherein the top conductor comprises an elongated segment having two parallel arms extending from a first side thereof, and wherein the slow wave structure comprises a ground terminal and a feed terminal disposed along an edge of the dielectric substrate, and wherein the elongated segment is disposed approximately above the edge.

11. An antenna comprising:

a dielectric substrate;

a slow wave structure disposed on a first surface of the dielectric substrate;

a top conductor disposed on a second surface, opposing the first surface of the dielectric substrate;

a conductive via extending through the dielectric substrate for connecting the slow wave structure to the top conductor; and wherein the top conductor comprises an elongated segment having two parallel arms extending from a first side thereof, and wherein the slow wave structure comprises a ground terminal and a feed terminal disposed along a first edge of the dielectric substrate, and wherein the elongated segment is disposed above a second edge of the dielectric substrate spaced apart from and parallel to the first edge.

12. The antenna of claim 1 wherein the slow wave structure comprises two differently sized spiral-shaped conductive elements.

13. The antenna of claim 1 wherein the slow wave structure comprises three spiral-shaped conductive elements.

14. The antenna of claim 1 wherein the slow wave structure comprises one spiral-shaped conductive element.

15. The antenna of claim 1 wherein the slow wave structure comprises two serpentine conductors.

16. The antenna of claim 1 wherein the conductive element comprises an L-shaped conductive element for connecting to ground.

17. An antenna comprising:

a dielectric substrate;

a slow wave structure disposed on a first surface of the dielectric substrate and further comprising a feed terminal and a ground terminal;

a top conductor disposed on a second surface, opposing the first surface of the dielectric substrate;

a conductive via extending though the dielectric substrate for connecting the slow wave structure to the top conductor; and a ground plane facing and spaced apart from the first surface and electrically connected to the ground terminal.

18. The antenna of claim 17 wherein the slow wave structure has a physical length, and wherein the effective electrical length of the slow wave structure is greater than the physical length.

19. The antenna of claim 17 wherein an angle formed by the plane of the dielectric substrate and the ground plane is adjustable.

20. The antenna of claim 19 wherein the operating characteristics of the antenna are a function of the angle.

21. The antenna of claim 17 wherein the slow wave structure comprises a first and a second serpentine conductor, and wherein an end of the first serpentine conductor comprises the feed terminal, and wherein an end of the second serpentine conductor comprises the ground terminal.

22. The antenna of claim 21 wherein the first and the second serpentine conductors each comprise a spiral-shaped conductor.

23. The antenna of claim 21 wherein the first and the second serpentine conductors are positioned in a side by side orientation.

24. An antenna comprising:

a dielectric substrate having first and second opposing surfaces;

a conductive region disposed on the first surface;

a first slow wave structure disposed on the second surface and electrically connected to the conductive region;

a second slow wave structure disposed on the second surface and electrically connected to the conductive region;

wherein a region of the first slow wave structure forms an antenna ground terminal;

wherein a region of the second slow wave structure forms an antenna feed terminal; and a ground plane spaced apart from the dielectric substrate, wherein the second surface is oriented in facing relation to the ground plane.

25. The antenna of claim 24 wherein the first and the second slow wave structures each comprise a serpentine conductor.

26. The antenna of claim 24 wherein the first and the second slow wave structures are electrically connected to the conductive region through a first and a second conductive via, respectively, extending through the dielectric substrate.

27. An antenna for connecting to a communications device, comprising:

a dielectric substrate having first and second opposing surfaces;

a conductive region disposed on the first surface;

a first slow wave structure disposed on the second surface and electrically connected to conductive region;

a second slow wave structure disposed on the second surface and electrically connected to the conductive region;

wherein a region of the first slow wave structure forms an antenna ground terminal;

wherein a region of the second slow wave structure forms an antenna feed terminal;

a ground plane spaced apart from the dielectric substrate, wherein the second surface is oriented in facing relation to the ground plane; and a feed line extending from the feed terminal for connection to the communications device, wherein the feed line extends over and is spaced-apart from the ground plane a predetermined distance as determined by the desired performance characteristics of the antenna.

28. The antenna of claim 27 wherein the feed line comprises a conductive plate having a predetermined width as determined by the desired performance characteristics of the antenna.

29. The antenna of claim 28 wherein the feed line comprises a first segment extending from the feed terminal toward the ground plane, a second segment electrically connected to a printed circuit board trace of the communications device, and a third substantially horizontal segment connecting the first and the third segments, wherein the third segment has a predetermined width and distance to the ground plane so as to achieve the desired antenna performance parameters.

30. An antenna for connecting to a signal terminal of a communications device, comprising:

a radiating element comprising:

a dielectric substrate;

a slow wave structure disposed on a first surface of the dielectric substrate;

a top conductor disposed on a second surface, opposing the first surface of the dielectric substrate; and a conductive via extending through the dielectric substrate for connecting the slow wave structure to the top plate;

a feed terminal connected to the radiating element;

a ground plane underlying and spaced apart from the radiating element; and a feed line comprising a first segment downwardly directed from the feed terminal toward the ground plane, a second segment electrically connected to the signal terminal, and a third substantially horizontal segment connecting the first and the third segments, wherein the third segment comprises a conductive plate having a predetermined width and distance to the ground plane so as to achieve the desired antenna performance parameters.

* * * * *